US012595666B2

(12) United States Patent
Cappelle et al.

(10) Patent No.: US 12,595,666 B2
(45) Date of Patent: Apr. 7, 2026

(54) PANEL

(71) Applicant: FLOORING INDUSTRIES LIMITED, SARL, Bertrange (LU)

(72) Inventors: Mark Cappelle, Staden (BE); Matthias Claerhout, Wielsbeke (BE); Bryan Rollier, Kanegem (BE); Christophe Naeyaert, Jabbeke (BE)

(73) Assignee: UNILIN, BV, Wielsbeke (BE)

( * ) Notice: Subject to any disclaimer, the term of this patent is extended or adjusted under 35 U.S.C. 154(b) by 96 days.

(21) Appl. No.: 17/916,300

(22) PCT Filed: Mar. 16, 2021

(86) PCT No.: PCT/IB2021/052176
§ 371 (c)(1),
(2) Date: Sep. 30, 2022

(87) PCT Pub. No.: WO2021/198826
PCT Pub. Date: Oct. 7, 2021

(65) Prior Publication Data

US 2023/0175272 A1 Jun. 8, 2023

(30) Foreign Application Priority Data

Apr. 3, 2020 (BE) ..... 2020/5217

(51) Int. Cl.
*E04F 15/02* (2006.01)

(52) U.S. Cl.
CPC ..... *E04F 15/02038* (2013.01); *E04F 2201/0161* (2013.01); *E04F 2201/023* (2013.01); *E04F 2201/042* (2013.01); *E04F 2201/043* (2013.01)

(58) Field of Classification Search
CPC ..... E04F 15/02033; E04F 15/02038; E04F 2201/023; E04F 2201/042;
(Continued)

(56) References Cited

U.S. PATENT DOCUMENTS 6,332,733 B1 * 12/2001 Hamberger ..... C08L 81/06 52/592.4
7,188,456 B2 * 3/2007 Knauseder ..... E04F 15/02 52/592.1
(Continued)

FOREIGN PATENT DOCUMENTS

JP H08109734 A 4/1996
WO 9426999 A1 11/1994
(Continued)

OTHER PUBLICATIONS

Search Report from corresponding Belgian Application No. BE 202005217, Dec. 17, 2020.
(Continued)

*Primary Examiner* — Kyle J. Walraed-Sullivan
(74) *Attorney, Agent, or Firm* — Workman Nydegger

(57) ABSTRACT

The panel includes a first pair of opposite edges; these comprise male and female coupling parts—in the form of a tongue and groove and locking elements—in order to couple two such panels to each other on their first pair of opposite edges. The panel and coupling parts thereof are configured so that in a covering formed with these panels, the expansion and contraction of the panels in the coupling zone on the first pair of opposite edges is compensated in this coupling zone itself.

16 Claims, 5 Drawing Sheets

(58) Field of Classification Search
CPC ..... E04F 2201/043; E04F 2201/02; E04F 2201/027; E04F 2201/028; E04F 2201/03; E04F 13/076; E04F 13/0894
See application file for complete search history.

(56) References Cited

U.S. PATENT DOCUMENTS

| | | | | |
|---|---|---|---|---|
| 10,100,532 | B2 * | 10/2018 | Schacht | E04F 15/02194 |
| 2002/0014047 | A1 * | 2/2002 | Thiers | B44C 1/24 52/316 |
| 2003/0024200 | A1 * | 2/2003 | Moriau | B27M 3/04 52/592.2 |
| 2005/0028474 | A1 * | 2/2005 | Kim | E04F 15/04 52/578 |
| 2005/0050827 | A1 * | 3/2005 | Schitter | E04F 15/02 52/578 |
| 2005/0138881 | A1 * | 6/2005 | Pervan | E04F 15/02 52/581 |
| 2005/0241255 | A1 * | 11/2005 | Kim | E04F 15/02 52/591.4 |
| 2006/0064940 | A1 * | 3/2006 | Cappelle | A47G 27/0293 52/589.1 |
| 2006/0150557 | A1 * | 7/2006 | Eisermann | B44F 9/02 52/578 |
| 2006/0179773 | A1 * | 8/2006 | Pervan | B44C 5/0469 52/592.1 |
| 2007/0175148 | A1 * | 8/2007 | Bergelin | E04B 1/68 52/480 |
| 2009/0249731 | A1 * | 10/2009 | Cappelle | F16B 5/0016 144/368 |
| 2009/0260313 | A1 * | 10/2009 | Segaert | B44C 5/043 52/592.1 |
| 2010/0293879 | A1 * | 11/2010 | Pervan | E04F 15/02038 52/588.1 |
| 2013/0104485 | A1 * | 5/2013 | Meersseman | B27N 7/00 428/53 |
| 2016/0177577 | A1 * | 6/2016 | Cappelle | B65D 85/62 52/582.2 |
| 2016/0288447 | A1 * | 10/2016 | Cordeiro | B32B 9/047 |
| 2018/0195291 | A1 * | 7/2018 | Loncke | B32B 29/002 |
| 2019/0085569 | A1 * | 3/2019 | Ryberg | B44C 5/04 |
| 2019/0106888 | A1 * | 4/2019 | Liu | B32B 37/0053 |
| 2019/0242139 | A1 * | 8/2019 | Meersseman | B32B 27/32 |
| 2019/0292793 | A1 * | 9/2019 | Van Vlassenrode | B32B 27/304 |
| 2020/0131784 | A1 * | 4/2020 | Boucké | E04F 15/105 |
| 2020/0284049 | A1 * | 9/2020 | De Rick | B32B 9/02 |
| 2020/0308846 | A1 * | 10/2020 | Josefsson | E04F 13/076 |
| 2021/0002907 | A1 * | 1/2021 | Boucké | E04F 15/02038 |
| 2021/0087829 | A1 * | 3/2021 | Ylikangas | B27G 13/14 |
| 2021/0114344 | A1 * | 4/2021 | Van Vlassenrode | B32B 7/023 |
| 2021/0148121 | A1 * | 5/2021 | Boquillon | B32B 27/304 |
| 2021/0237397 | A1 * | 8/2021 | Van Vlassenrode | E04F 15/02038 |
| 2021/0310256 | A1 * | 10/2021 | Boo | E04F 15/04 |
| 2022/0034097 | A1 * | 2/2022 | Boucké | B32B 5/18 |
| 2022/0056692 | A1 * | 2/2022 | Romans | E04C 2/44 |
| 2022/0056703 | A1 * | 2/2022 | Boucke | E04F 15/105 |
| 2022/0243483 | A1 * | 8/2022 | Clement | B32B 21/06 |
| 2022/0298802 | A1 * | 9/2022 | Ylikangas | E04F 15/02038 |
| 2022/0341185 | A1 * | 10/2022 | De Rick | E04F 15/02016 |
| 2023/0175272 | A1 * | 6/2023 | Cappelle | E04F 15/02033 52/588.1 |
| 2023/0228100 | A1 * | 7/2023 | De Rick | B27F 1/02 52/588.1 |
| 2023/0287690 | A1 * | 9/2023 | Brouckaert | B44F 9/02 |
| 2023/0366210 | A1 * | 11/2023 | Boucké | E04F 15/02016 |
| 2024/0093506 | A1 * | 3/2024 | De Rick | E04F 13/0894 |
| 2024/0125129 | A1 * | 4/2024 | Fahle | E04F 15/02038 |

FOREIGN PATENT DOCUMENTS

| | | | |
|---|---|---|---|
| WO | 9747834 | A1 | 12/1997 |
| WO | 0196688 | A1 | 12/2001 |
| WO | 0198603 | A2 | 12/2001 |
| WO | 2004081316 | A1 | 9/2004 |
| WO | 2005068747 | A1 | 7/2005 |
| WO | 2006066639 | A1 | 6/2006 |
| WO | 2006074824 | A2 | 7/2006 |
| WO | 2006103565 | A2 | 10/2006 |
| WO | 2008005333 | A2 | 1/2008 |
| WO | 2008053333 | A2 | 5/2008 |
| WO | 2011075074 | A1 | 6/2011 |

OTHER PUBLICATIONS

International Search Report from corresponding PCT Application No. PCT/IB2021/052176, Jun. 8, 2021.

* cited by examiner

PANEL

TECHNICAL FIELD

The invention relates to panels (for example floor panels, wall panels or ceiling panels), which comprise mechanical coupling parts on at least two opposite edges. The invention further relates to coverings that are assembled from such panels.

PRIOR ART

Floor panels are known that are intended to form a floating floor covering. During installation, such floor panels can be coupled together at their edges by means of mechanical coupling parts, whether or not made as one piece with the floor panel.

These mechanical coupling parts provide, both in the horizontal direction and in the vertical direction, mutual locking of the floor panels, for example as described in the International patent applications WO94/26999, WO97/47834, WO01/98603 and WO01/96688.

Floating movement of floor panels allows the floor covering to expand or contract freely in changing environmental conditions. In order to allow expansion, the floor covering is only laid up to a certain distance, of the order of magnitude of 1 centimetre, from the wall of a room. The space that is thus left clear at the edge of the room, commonly called an expansion gap, is usually covered with a finishing profile or end profile. With the existing floating floor coverings it is also recommended to apply such expansion gaps in the floor surface whenever the area of the floor covering is too large and for example exceeds a distance of 12 metres in length or in the transverse direction. For covering an expansion gap in the surface of the floor covering, a finishing profile, more particularly an expansion profile, is also used. The aforementioned end profiles and expansion profiles are described for example in WO2006/074824. The aforementioned finishing profiles, and in particular the aforementioned expansion profiles that are present in the surface of the floor covering, are perceived as annoying by the user, since they interrupt the floor surface because they project above the floor surface and usually have dimensions different from the floor panels themselves. There has long been a need to avoid or to limit the use of such profiles. Furthermore, there is a need to limit the dimensions of the required expansion gap.

In variable environmental conditions, floor coverings laid floating in addition have yet other disadvantages in the case when heavy loads, such as furniture, are placed on the floor surface. Such loads may hamper or prevent the free expansion and/or contraction of the floor. Said hampering or preventing may lead to unlocking of floor panels in the floor covering during contraction and to lifting of the floor covering during expansion.

Some suggestions are known from the prior art for wholly or partially avoiding the problems outlined above and/or for wholly or partially meeting the need outlined above.

The solutions that are presented in WO94/26999, WO2005/068747 and WO2006/066639 in each case relate to floor panels that can be coupled on their edges by means of mechanical coupling parts that are provided with a certain amount of inbuilt clearance. This clearance can provide mutual freedom of movement between the coupled floor panels. Another example of such a coupling is known from WO2004/081316. In this last-mentioned document, however, the clearance space is filled with a seal material that does not possess any mechanical strength. In the proposals in each of the international applications cited here, however, there is a risk that floor panels are placed initially in a position in which the upper edges of the respective floor panels already touch each other, so that if there is any expansion they can no longer move towards each other, and the solution presented can only be operative in a situation where the floor panels tend to move away from each other, such as during contraction. The opposite is also possible, namely that the floor panels are placed in an initial mutual position wherein they can no longer move away from each other, such as during contraction.

From JP 8-109734 it is known to produce mechanical coupling parts in such a way that the floor panels initially are always placed in such a way that there is a space at the level of the upper edges of the coupled floor panels, between the respective coupled sides. With the floor panels known from this document it is always possible to some extent to allow for expansion of the floor panels, or in other words it is always possible to allow the coupled floor panels to move towards each other to some extent. With the solution presented in this document it is, however, impossible to allow for contraction of the floor panels.

WO2008/05333 describes floor panels that comprise coupling means on two opposite edges. These coupling means provide a coupled state of two such floor panels in locking both in a vertical direction perpendicular to the plane defined by the coupled floor panels and in a horizontal direction perpendicular to the respective edges and in the plane of the coupled floor panels. The coupling means comprise positioning means wherein these positioning means force, or bring, two such floor panels into an initial locked mutual position during coupling. The coupled floor panels can leave the aforementioned initial mutual position by pushing in a locked state in the horizontal direction towards each other or away from each other, and in that the aforementioned coupling means, when the coupled floor panels leave the aforementioned initial mutual position, both during movement towards each other and during movement away from each other, provide a restoring force to the aforementioned initial mutual position.

WO2011/07574A1 describes floor panels that comprise mechanical coupling parts on opposite edges. The floor panels comprise a core with curved edges, so that a surface layer on the core is located, at the first edge, below the upper surface of the panel. The edges of the floor panel comprise a chamfer or bevel, so that when two such floor panels are coupled to each other, the surface layer and a part of the core of the second edge in the junction of these coupled floor panels overlap the surface layer of the first coupled edge-said surface layer being parallel to the upper surface of the panel. It is described as an advantage that expansion and contraction of the floor panels owing to a change in temperature or humidity do not result in visible openings between the floor panels.

DESCRIPTION OF THE INVENTION

It is an aim of the invention to describe improved floor panels.

It is an aim of the invention to describe floor panels that are more resistant to changes in air humidity.

It is a particular aim of the invention to describe floor panels wherein the coupling between two such floor panels can compensate the expansion and contraction of the panels due to variable humidity in the coupling between the panels.

It is a particular aim of the invention to describe panels with which larger areas of covering can be placed without objects—such as expansion profiles—having to be installed between panels in order to allow expansion and contraction of the covering with variable humidity or temperature. It is an aim to obtain a covering that is visually attractive at different temperatures and degrees of humidity.

The invention focuses on panels, such as floor panels for laying floor coverings, but is not limited to floor panels and floor coverings. The invention also relates to panels for wall or ceiling coverings.

The invention relates to a number of independent aspects which—separately or in combination—ensure that expansion and contraction of panels in a covering formed by these panels in at least one direction in the coupling zone between individual panels is compensated. This signifies that the covering seen as a whole in at least one direction in fact does not expand, apart from the expansion owing to the panel at the lateral edge of the covering.

The first aspect of the invention is a panel. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel in the first aspect of the invention is characterized in that the tongue and the upper lip are configured with overlapping contours, so that in the coupled state of two such panels, on their first pair of opposite edges a pretension is formed between the tongue of the panel and the upper lip of said coupled panel.

"In the coupled state" is understood by a person skilled in the art to mean that the upper surfaces of the coupled panels lie in the same plane.

It is an advantage of panels according to this first aspect that the contact surface on the upper side of the panel is formed between the top edge of the tongue and the bottom of the lower lip of the coupled panels. Owing to the aforementioned pretension, good coupling develops, which provides a visually high-quality surface of the covering formed by the panels. Absence of contacting closing faces between the first edge and the second edge on the upper side of the panels ensures that on expansion or contraction of the panels coupled on their first edges, the coupled panels can move relative to one another over the contact surface formed by the overlapping contours of the panels, so that expansion and contraction are compensated in the coupling zone on the first pair of opposite edges of the coupled panels.

Preferably, the overlap of the overlapping contours in the direction perpendicular relative to the surface of the panel is at least 0.03 millimetre; and preferably at least 0.05 millimetre. A higher value for the overlap provides better coupling of the panels, which is maintained better on expansion or contraction of the panels, so that a visually high-quality appearance is preserved even on expansion or contraction of the panels under the effect of varying temperature or humidity.

Preferably, on account of this pretension, in the coupled state, the lower lip is bent downwards at any degree of humidity. Preferably this is because the upper lip presses on the tongue, and the tongue in its turn presses on the lower lip. When there is a change in temperature and humidity, more or less curvature of the lower lip can—by altering the stresses in the material—take up the stresses in the material.

Preferably, owing to the pretension, it is the tongue that bends, and not the upper lip. Such embodiments help to obtain—at any temperature or humidity—a visually high-quality surface of a covering made with such panels.

Preferably, the overlapping contours in the coupled state of the panel on its first edge with another such panel on its second edge, provide a contact surface between the upper edge of the tongue of the panel and the bottom edge of the upper lip, wherein this contact surface is parallel to the upper surface of the thus coupled panels. Such embodiments allow efficient compensation of contraction and expansion of the panels in the coupling zone itself, since the panels can move parallel relative to one another relative to their surface.

The second aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel in the second aspect of the invention is characterized in that the panel comprises, on the upper side, a bevel on its first edge. This bevel may be straight and/or curved. The top edge of the tongue comprises a contact surface. Preferably this contact surface is parallel to the upper side of the panel. The contact surface is provided for making contact with the bottom edge of the upper lip of another such panel, to which the panel is coupled on its first edge. The tongue comprises a slot. This slot is located between the bevel on the first edge and the contact surface on the top edge of the tongue.

Panels according to the second aspect of the invention have the same advantages as panels according to the first aspect of the invention. The slot allows such panels to be produced more easily. The bevel on the first edge can be produced more easily by pressing with the slot, whereas the contact surface on the top can be produced to narrow tolerances. As a result, a visually high-quality covering can be made with these panels, which maintain their high visual quality at all temperatures and relative humidities in the room where the covering is placed.

Preferably the slot has a depth relative to the uppermost point of the tongue of at least 0.05 millimetre, more preferably of at least 0.1 millimetre, even more preferably of at least 0.15 millimetre.

Preferably, the width of the slot is greater than its depth, wherein the depth is measured relative to the uppermost point of the tongue.

Preferably, in the coupled state just after coupling the panel on its first edge to the second edge of a second such panel, at least one part of the slot is visible from above. Preferably, the panels are installed—and thus coupled to each other on their first pair of opposite edges-after the panels are brought into equilibrium with an average temperature and an average relative humidity that may occur in the room where the panels are installed. Their precise values are not relevant, since they can vary widely. Depending on the circumstances in which the panels are in equilibrium on installation, temperatures and relative humidities may prevail in the room which produce both expansion and contraction of the panels. This contraction and expansion can be compensated in the coupling zone of the panels, through relative movement of the panels relative to one another over the contact surfaces on the top edge of the tongue and the bottom edge of the upper lip. Since the slot was at least partially visible from above on installation, expansion of the panels is possible, wherein the expansion in the coupling zone is compensated because a larger part of the slot is then no longer visible from above, since it is now underneath the upper lip of the coupled panel.

Preferably, the panel comprises a substrate and a decorative design, wherein the decorative design runs continuously from the upper surface over the bevel on the first edge of the panel up to at least a part of the slot; and preferably over the entire slot. An advantage of such embodiments is that a qualitatively better visual appearance of a covering is obtained with such panels, since the decorative design is interrupted visually less or not at all.

Preferably the decorative design comprises a decorative layer. Preferably the decorative layer comprises a decorative print.

Preferably the decorative layer comprises a layer of paper, more preferably a printed layer of paper, more preferably a melaminized layer of paper.

Preferably the decorative layer comprises a film, preferably a printed film.

Preferably the decorative design on the tongue does not run beyond the slot. This ensures that the surface of the tongue that will come into contact with the underside of the uppermost side can be produced to narrow tolerances. As a result, high-quality coverings can be made. Such embodiments may for example be produced by making the contact surface on the top edge of the tongue by a milling operation.

Preferably the decorative design on the first edge does not run through onto the contact surface on the top edge of the tongue.

Preferably, the contact surface on the top edge of the tongue is a milled contact surface.

Preferably, the panel comprises a substrate and a decorative design, wherein the contact surface on the top edge of the tongue is formed by substrate.

In preferred embodiments, the decorative design on the first edge runs through up to, but not onto the contact surface on the top edge of the tongue. Such embodiments ensure narrow tolerances of the contact surface, whereas from above the coupled panels, the decorative design is most visible, in any circumstances of temperature and humidity. As a result, a visually high-quality covering is obtained in all circumstances of temperature and humidity.

Preferably, the decorative design on the tongue runs continuously through to beyond the slot. Therefore the decorative design will always be visible from above the covering to the coupling on the first pair of opposite edges of the panels; i.e. in all circumstances of temperature and relative humidity in the room where the panels are installed. As a result, a visually high-quality covering is obtained in all circumstances of temperature and humidity.

Preferably, the panel comprises a bevel on the top of its second edge. This bevel may be straight and/or curved. The contact surface of the top of the first edge is located in the coupled state of the panel on its first edge, on the second edge of another such, completely under the bevel on the top of the second edge of the other such panel. Said bevel enhances the high-quality effect of the covering when there are changes in temperature or humidity; because the bevel makes the movement of the coupled panels relative to one another less visible.

The third aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel of the third aspect of the invention is characterized in that the panel comprises a substrate and a decorative design. The panel comprises a bevel on the top of its first edge and its second edge. This bevel may be straight and/or curved. The decorative design runs continuously through from the upper surface over the bevel on the first edge of the panel up to at least a part of the upper surface of the tongue. The decorative design runs continuously through from the upper surface up to the bevel on the second edge of the panel. The second edge comprises a second bevel under the bevel on the second edge. This second bevel may be straight and/or curved. Viewed from top to bottom, this second bevel is directed inwards. The decorative design does not run through up to the second bevel. "Viewed from top to bottom" means in the direction away from the surface of the panel that comprises the decorative design.

It is an advantage of panels according to the third aspect of the invention that the presence of this second bevel allows a greater extent of expansion of the panels in the coupling on the first pair of opposite edges of the panels to be compensated. This second bevel does not cause adverse visual appearance, since this second bevel, seen from above, is largely hidden under the bevel on the second edge. The second bevel also prevents development of a mechanically weak point on the bottom of the bevel on the second edge.

For example, during installation, at this mechanically weak point small pieces or fragments could break away on the second edge of the panel, which might well lead to visual defects in installed panels.

Preferably this second bevel has a height, measured perpendicular to the plane of the panel, of at least 0.10 millimetre, preferably of at least 0.15 millimetre, more preferably at least 0.20 millimetre.

Preferably the decorative design comprises a decorative layer. Preferably the decorative layer comprises a decorative print.

Preferably the decorative layer comprises a layer of paper, more preferably a printed layer of paper, more preferably a melaminized layer of paper.

Preferably, the panel of any of the embodiments of any of the aspects of the invention is formed as a "DPL" (Direct Pressure Laminate). Preferably, the panel then comprises a top layer that comprises one or more carrier films, for example paper that is impregnated with resin, preferably with melamine resin. During forming of the panel as a "DPL" (Direct Pressure Laminate) the top layer is pressed directly onto the substrate. Forming of the panel as a Direct Pressure Laminate has the advantage that the decorative design can be more continuous, or bevels and up to at least a part of the tongue can be formed.

Preferably the decorative layer comprises a film, preferably a printed film.

Preferably, in the cross-section perpendicular to the first pair of opposite edges, the second bevel has, in at least one point thereof, a tangent which, relative to the upper surface of the panel, makes an angle of more than 40°, preferably more than 50°, more preferably more than 60°, even more preferably more than 70°.

Preferably, in the cross-section perpendicular to the first pair of opposite edges, the second bevel is flat over at least one part thereof.

Preferably, in the coupled state of the panel with its first edge on the second edge of another such panel in the direction perpendicular to the plane of the panel, the upper lip of the other such panel lies partly above a portion of the tongue of the panel containing a decorative design.

The fourth aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels.

The male coupling part and the female coupling part each comprise a locking element. These locking elements produce, in the coupled state, a mechanical locking between the panels in the direction in the plane of the panels and perpendicular to the first pair of opposite edges.

The panel of the fourth aspect of the invention is characterized in that, in the coupled state directly after coupling of the panel on its first edge to the second edge of a second such panel, a part of the tongue is visible from above.

As a result, movement of the coupled panels relative to one another is possible during expansion and/or contraction if there is a change of temperature and/or relative humidity relative to the circumstances in which the panels are installed—and thus coupled.

The fifth aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel of the fifth aspect of the invention is characterized in that, underneath the tongue, there is a first contact surface, a first inclined abutting surface and a second inclined abutting surface. In the distal direction of the panel, the first contact surface lies farther than the first inclined abutting surface, and the first inclined abutting surface lies farther than the second inclined abutting surface. On top of the lower lip there is a first counter-contact surface, a first inclined counter-abutting surface, and a second inclined counter-abutting surface. In the distal direction of the panel, the second inclined counter-abutting surface lies farther than the first inclined counter-abutting surface, and the first inclined counter-abutting surface lies farther than the first counter-contact surface. Preferably, the first contact surface is located, relative to the first inclined abutting surface—and more preferably also relative to the second inclined abutting surface—in the direction perpendicular to the surface of the panel seen on average—and preferably fully—closer to the upper surface of the panel. In the coupled state of the panel with another such panel, the first contact surface comes into contact with the first counter-contact surface, wherein on expansion or contraction of these coupled panels the first contact surface of the panel and the first counter-contact surface of the other such panel can move over one another. Depending on the extent of expansion or contraction of the panel and the other such panel with which the panel is coupled on its first edge to the second edge of the other such panel, there can be contact between the first inclined abutting surface of the panel with the first inclined counter-abutting surface of the other such panel, or of the second inclined abutting surface of the panel with the second inclined counter-abutting surface of the other such panel. But wherein there is not, in any situation at all, contact both between the first inclined abutting surface of the panel with the first inclined counter-abutting surface of the other such panel and between the second inclined abutting surface of the panel with the second inclined counter-abutting surface of the other such panel. Panels according to the fifth aspect of the invention ensure that expansion and contraction of the panels can be compensated efficiently in the coupling zone on the first pair of opposite edges. Initially this is by movement of the coupled panels relative to one another. Furthermore, the stresses between abutting surfaces and counter-abutting surfaces are compensated by a (further) bending of the lower lip.

Preferably, the contact in the coupled state between the first contact surface of the panel and the first counter-contact surface of the other such panel is parallel to the upper surface of the panel. This facilitates movement of the panels relative to one another on contraction and expansion.

Preferably there is an inclined sliding surface underneath the tongue. In the distal direction of the panel, the second inclined abutting surface lies farther than the inclined sliding surface. The slope of the inclined sliding surface is smaller than the slope of the second inclined abutting surface; and is preferably less than or equal to the slope of the first inclined abutting surface. On top of the lower lip there is an inclined counter-sliding surface. In the distal direction of the panel, the counter-sliding surface lies farther than the second inclined counter-abutting surface. The slope of the inclined counter-sliding surface is smaller than the slope of the second inclined counter-abutting surface and is preferably less than or equal to the slope of the first inclined counter-abutting surface. The inclined sliding surface is located, relative to the first inclined abutting surface and the second inclined abutting surface in the direction perpendicular to the surface of the panel, closer to the upper surface of the panel. The inclined sliding surface of the panel is provided for coming into contact with the inclined counter-sliding surface of the other such panel in the coupled state just after coupling the panel to the other such panel, so that a locking of these coupled panels is obtained in the plane of the coupled panels and perpendicular to their first pair of opposite edges. In these embodiments, an effective locking is obtained between the coupled panels in the direction in the plane of the panels and perpendicular to the first pair of opposite edges; and this locking is maintained even during contraction and expansion of the panels when there is a change in temperature and/or relative humidity.

Preferably, the first pair of opposite edges is designed in such a way that just after coupling there is an overlap between the inclined sliding surface of the panel and the inclined counter-sliding surface of the other such panel to which the panel is coupled on its first edge; so that in the coupled state, the inclined sliding surface of the panel with pretension comes into contact with the inclined counter-sliding surface of the other such panel. This pretension ensures efficient coupling and locking of the coupled panels.

Preferably, in the coupled state of the panel on its first edge with the second edge of another such panel, there is a space under the tongue and between the first inclined abutting surface and the second inclined abutting surface and above the lower lip. "A space" means that this space does not contain any material.

Preferably the slopes of the first inclined abutting surface and of the second inclined abutting surface are in opposite directions.

Preferably the first edge and the second edge are configured so that on contact between the first inclined abutting surface of the panel with the first inclined counter-abutting surface of another such panel to which the panel is coupled, on further expansion of the panels a stress develops between this first inclined abutting surface and the first inclined counter-abutting surface with which the first inclined abutting surface comes into contact, which causes a bending of the lower lip of the other such panel. This bending provides compensation of expansion stresses.

Preferably the first edge and the second edge are configured so that on contact between the second inclined abutting surface of the panel with the second inclined counter-abutting surface of another such panel to which the panel is coupled, on further contraction of the panels a stress develops between this second inclined abutting surface and the second inclined counter-abutting surface with which the second inclined abutting surface comes into contact, which causes a bending of the lower lip of the other such panel. This bending provides compensation of shrinkage stresses.

Preferably the panel has a first closing face on the first edge above the tongue and the second edge comprises a second closing face. With a certain expansion of the panel and of another such panel with which the panel is coupled on its first edge to the second edge of the other such panel, there is contact between the first closing face of the panel and the second closing face of the other such panel.

Preferably, directly after coupling of the panel on its first edge to the second edge of the other such panel, between the first closing face of the panel and the second closing face of the other such panel in the direction perpendicular to the first pair of opposite edges of the thus coupled panels there is at least a distance of 0.35 millimetre. Since the panels are normally installed and thus coupled in equilibrium with relative humidities occurring on average, this value of this distance means that at the current distance between the first pair of opposite edges of the panels, the expansion at the most extreme relative humidities can still always be compensated in the coupling zone on the first pair of opposite edges of coupled panels.

Preferably the first edge and the second edge are configured so that on contact between the first inclined abutting surface of the panel with the first inclined counter-abutting surface of another such panel to which the panel is coupled, in the direction perpendicular to the first pair of opposite edges, there is a distance of more than 0.3 mm; and preferably more than 0.35 mm between the second inclined abutting surface of the panel and the second inclined counter-abutting surface of the other such panel. Since the panels are normally installed and thus coupled in equilibrium with relative humidities occurring on average, this value of the distance means that at the current distance between the first pair of opposite edges of the panels, the change in dimensions with the most extreme change in relative humidities can still always be compensated in the coupling zone on the first pair of opposite edges of coupled panels.

Preferably the first edge and the second edge are configured so that on contact between the second inclined abutting surface of the panel with the second inclined counter-abutting surface of another such panel to which the panel is coupled, in the direction perpendicular to the first pair of opposite edges, there is a distance of more than 0.3 mm; and preferably more than 0.35 mm between the first inclined abutting surface of the panel and the first inclined counter-abutting surface of the other such panel. Since the panels are normally installed and thus coupled in equilibrium with relative humidities occurring on average, this value of the distance means that at the current distance between the first pair of opposite edges of the panels, the change in dimensions with the most extreme change in relative humidity can still always be compensated in the coupling zone on the first pair of opposite edges of coupled panels.

Preferably, the included angle of inclination of the second inclined counter-abutting surface with the plane of the panel is greater than the included angle of inclination of the first inclined counter-abutting surface with the plane of the panel; this difference is preferably more than 25°, more preferably more than 30°.

Preferably, the included angle of inclination of the first inclined abutting surface with the plane of the panel is at least 25°, and preferably at least 30°.

Preferably there is a zone underneath the tongue between the first contact surface and the first inclined abutting surface. In all conditions of humidity and temperature, in the coupled state on the first edge of the panel to the second edge of another such panel in the direction parallel to the surface of these coupled panels, there is a space between this zone and the lower lip of the other such panel to which the panel is coupled on its first edge.

The sixth aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel of the sixth aspect of the invention is characterized in that underneath the tongue there is a first inclined abutting surface and a second inclined abutting surface. In the distal direction of the panel, the first inclined abutting surface lies farther than the second inclined abutting surface. On top of the lower lip there is a first inclined counter-abutting surface, and a second inclined counter-abutting surface. In the distal direction of the panel, the second inclined counter-abutting surface lies farther than the first inclined counter-abutting surface. Depending on the extent of expansion or contraction of the panel and the other such panel with which the panel is coupled on its first edge to the second edge of the other such panel, there can be contact between the first inclined abutting surface of the panel with the first inclined counter-abutting surface of the other such panel, or of the second inclined abutting surface of the panel with the second inclined counter-abutting surface of the other such panel. However, there is not, in any situation at all, contact both between the first inclined abutting surface of the panel with the first inclined counter-abutting surface of the other such panel, and between the second inclined abutting surface of the panel with the second inclined counter-abutting surface of the other such panel. The first edge and the second edge are configured so that on contact between the first inclined abutting surface of the panel with the first inclined counter-abutting surface of another such panel to which the panel is coupled, in the direction perpendicular to the first pair of opposite edges, there is a distance of more than 0.3 mm; and preferably more than 0.35 mm between the second inclined abutting surface of the panel and the second inclined counter-abutting surface of the other such panel.

Panels according to the sixth aspect of the invention ensure that expansion and contraction of the panels can be compensated efficiently in the coupling zone on the first pair of opposite edges. This is initially by movement of the coupled panels relative to one another. Furthermore, the stresses between the inclined abutting surfaces and the inclined counter-abutting surfaces are compensated by a (further) bending of the lower lip.

The seventh aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel of the seventh aspect of the invention is characterized in that underneath the tongue there is a first inclined abutting surface and a second inclined abutting surface. In the distal direction of the panel, the first inclined abutting surface lies farther than the second inclined abutting surface. On top of the lower lip there is a first inclined counter-abutting surface, and a second inclined counter-abutting surface. In the distal direction of the panel, the second inclined counter-abutting surface lies farther than the first inclined counter-abutting surface. Depending on the extent of expansion or contraction of the panel and the other such panel with which the panel is coupled on its first edge to the second edge of the other such panel, there can be contact between the first inclined abutting surface of the panel with the first inclined counter-abutting surface of the other such panel, or of the second inclined abutting surface of the panel with the second inclined counter-abutting surface of the other such panel; but wherein there is not, in any situation at all, contact both between the first inclined abutting surface of the panel with the first inclined counter-abutting surface of the other such panel and between the second inclined abutting surface of the panel with the second inclined counter-abutting surface of the other such panel. The first edge and the second edge are configured so that on contact between the second inclined abutting surface of the panel with the second inclined counter-abutting surface of another such panel to which the panel is coupled, in the direction perpendicular to the first pair of opposite edges, there is a distance of more than 0.3 mm; and preferably more than 0.35 mm between the first inclined abutting surface of the panel and the first inclined counter-abutting surface of the other such panel.

Panels according to the seventh aspect of the invention ensure that expansion and contraction of the panels can be compensated efficiently in the coupling zone on the first pair of opposite edges. This is initially by movement of the coupled panels relative to one another. Furthermore, the stresses between abutting surfaces and counter-abutting surfaces are compensated by a (further) bending of the lower lip.

The eighth aspect of the invention is a panel, optionally such as in any of the other aspects of the invention. The panel comprises a first pair of opposite edges, namely a first edge and a second edge. The first edge comprises a male coupling part. The second edge comprises a female coupling part. The male coupling part and the female coupling part are configured in such a way that two such panels can, by means of their male and female coupling parts, be coupled to each other in one plane and a coupled state can thus be realized between the panels. The male coupling part comprises a tongue. The female coupling part comprises a groove. The groove is delimited by an upper lip and a lower lip. Preferably the lower lip extends in the distal direction beyond the open or free end of the upper lip. In the coupled state, the tongue and the groove form a tongue-and-groove joint, which produces a mechanical locking between the panels in the direction perpendicular to the plane of the panels. The male coupling part and the female coupling part each comprise a locking element. These locking elements produce, in the coupled state, a mechanical locking between the panels in the direction in the plane of the panels and perpendicular to the first pair of opposite edges.

The panel of the eighth aspect of the invention is characterized in that the panel has a first closing face on the first edge above the tongue; and in that the second edge has a second closing face. Directly after coupling of the panel on its first edge to the second edge of the other such panel between the first closing face of the panel and the second closing face of the other such panel in the direction perpendicular to the first pair of opposite edges of the thus coupled panels, there is at least a distance of 0.35 millimetre. At a certain expansion of the panel and of the other such panel with which the panel is coupled on its first edge to the second edge of the other such panel, there is contact between the first closing face of the panel and the second closing face of the other such panel.

Since the panels are normally installed and thus coupled in equilibrium with relative humidities occurring on average, this value of the distance means that at the current distance between the first pair of opposite edges of the panels, the expansion at the most extreme relative humidity can still always be compensated in the coupling zone on the first pair of opposite edges of coupled panels.

The embodiments that follow can be combined with any of the aspects already described—and their respective embodiments—of the invention.

Preferably the second edge comprises a notch or an undercut under the lower lip. "Notch" means that there is material of the panel under at least one part of the notch. "Undercut" means that there is no material of the panel over the entire undercut. An advantage of such embodiments is that expansion and shrinkage stresses can be compensated more easily, by bending of the lower lip. This embodiment is useful with thicker panels, although the tongue can still be placed high relative to the thickness of the panel; and the lower lip still remains pliable to take up the expansion and shrinkage stresses by bending the lower lip downwards. WO2006/103565 shows such a notch, but for a different reason. In WO2006/103565, the purpose of the notch is to allow easier coupling on installation of the panels.

More preferably, the length of the notch or undercut measured in the plane parallel to the surface of the panel and perpendicular to the second edge is smaller than the distance between the most distal point of the upper lip and the most distal point of the lower lip. Such embodiments allow effective compensation of expansion and shrinkage stresses.

Preferably, in embodiments wherein the second edge comprises a notch or an undercut under the lower lip, the lower lip possesses, on its top, a most proximal contact surface, wherein the most proximal contact surface in the coupled state comes into contact with the underside of the tongue of a coupled panel. In the coupled state of the panel, on its second edge there is no contact surface on the upper side of the lower lip more proximal than the most proximal contact surface. The notch or the undercut does not extend from the distal end of the second edge to beyond the most proximal contact surface.

In a preferred embodiment, the locking element of the male coupling part is provided on the underside of the tongue. The locking element of the female coupling part is provided on the upper side of the lower lip.

In preferred embodiments, the panel is rectangular and elongated; and the first pair of opposite edges are located on the long edges of the panel.

Preferably the panel can be coupled with its first edge to the second edge of another such panel by means of a rotating movement; and/or by means of a sliding movement parallel to the plane of the panel with a snap effect.

Preferably, the panel is rectangular—either square or oblong—and the panel comprises a second pair of opposite edges, more specifically a third edge and a fourth edge. On its second pair of opposite edges, the panel possesses coupling parts, which allow the panel to be coupled on its third edge to the fourth edge of another such panel, wherein a locking occurs in the direction in the plane of the thus coupled panels and perpendicular to the thus coupled edges; and perpendicular to the plane of the coupled panels.

Preferably the coupling parts of the second pair of opposite edges are designed so that the panel can be coupled on its third edge to the fourth edge of another such panel by means of one or more of: a rotating movement, pushing the panel parallel to the plane of the panel with a snap effect, or movement of the third edge of the panel perpendicular to the plane of the panel.

Preferably, the panel is rectangular, either square or oblong. The panel changes under the influence of temperature changes and/or changes in air humidity, in relative terms, less in dimension in the direction parallel to the first pair of opposite edges than in the direction perpendicular to the first pair of opposite edges.

In a preferred embodiment the panel is mainly constructed from a material that mainly consists of wood fibres.

Preferably, the panel comprises an MDF (Medium Density Fibreboard) or HDF (High Density Fibreboard) substrate.

Preferably the panel comprises a substrate and a decorative design. More preferably the panel comprises a decorative layer, preferably wherein the decorative layer comprises a decorative print.

Preferably the decorative layer comprises a layer of paper, more preferably a printed layer of paper, more preferably a melaminized layer of paper.

Preferably, the panel comprises a top layer that comprises a number of carrier films, for example paper that is impregnated with resin, for example melamine resin. In such cases the panel may be formed as a "DPL" (Direct Pressure Laminate), wherein the top layer is pressed directly onto the substrate. It is also possible to make the panel by the "HPL" (High Pressure Laminate) process, wherein the top layer is obtained by a pressing operation, before the top layer as a whole is applied on the substrate. Other technologies for forming the top layer may also be used. For example by using films, applying a product that has to be cured (for example varnish or a resin).

The decorative design is usually printed, either directly on the substrate—possibly using a primer—or on one or more coatings or on a film.

In a preferred embodiment the decorative layer comprises a printed film.

One aspect of the invention is floor, wall or ceiling covering, assembled from panels such as in any embodiment of the various aspects of the invention.

In this connection, where "above" and "under" are stated in this text, this is to be understood in the meaning of using the panel as a floor panel. This signifies that in the case of wall and ceiling panels and wall and ceiling coverings, "above" means the side of the panel that is directed towards the space or room in which the panel is installed; and so is visible. "Under" means, in the case of wall and ceiling panels and wall and ceiling coverings, the side of the panel that is directed away from the space or room in which the panel is installed and so is not visible.

Preferably, the floor, wall or ceiling covering according to the invention has, in the direction perpendicular to the first pair of opposite edges of the panels, a length of at least 15 metres, and preferably of at least 20 metres; wherein, over this length, all adjacent panels are coupled to each other on their first pair of opposite edges by means of their respective coupling parts, without fitting separate profiles between the panels in order to compensate expansion and contraction of the covering in the transverse direction on the first pair of opposite edges. Thus, larger areas can be covered without having to install the special profiles for compensating the expansion and contraction of the covering.

Preferably, the panel according to the invention comprises a counter-layer on the side other than the side formed by the decorative design.

BRIEF DESCRIPTION OF THE FIGURES

For the purpose of better clarification of the features of the invention, some preferred embodiments are described hereunder, as examples without any limiting character, referring to the appended drawings.

DESCRIPTION OF EXAMPLES OF EMBODIMENTS

Figure 1:
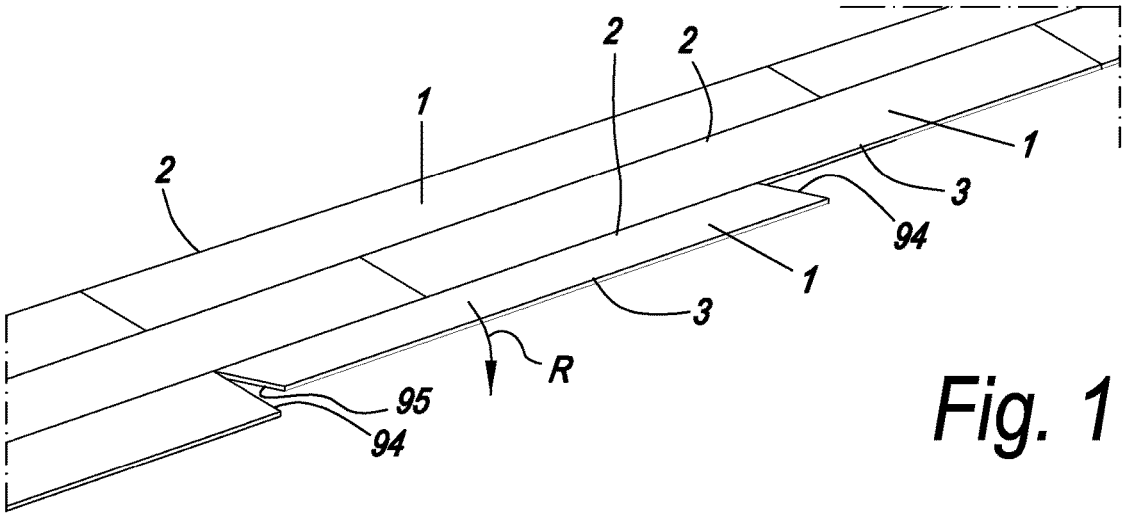
FIG. 1 shows schematically an example of a floor covering according to one aspect of the invention, with panels according to the invention.
Figure 2:
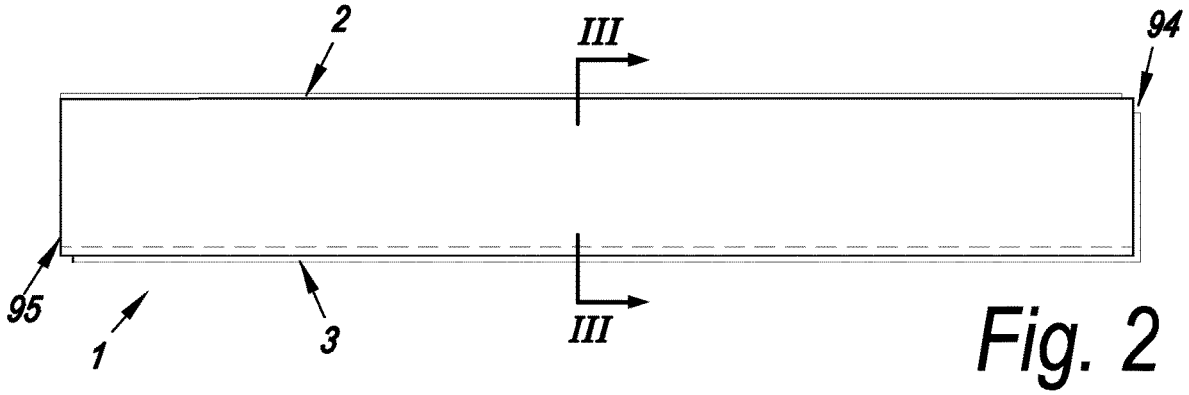
FIG. 2 shows a top view of an example of a panel according to the invention used in the floor covering in FIG. 1.

FIG. 1 shows schematically an example of a floor covering according to one aspect of the invention, with panels (1) according to the invention. FIG. 2 shows a top view of an example of a panel (1) according to the invention used in the floor covering in FIG. 1. The panels (1) of the floor covering in FIG. 1 are rectangular and elongated. The panels possess, on their long sides, a first pair of opposite edges (2, 3). The covering has, in the direction perpendicular to the first pair of opposite edges (2, 3) of the panels, a length of at least 15 metres, and preferably of at least 20 metres. Over this length, all adjacent panels are coupled to each other on their first pair of opposite edges (2, 3) by means of their respective coupling parts, without fitting separate profiles between the panels to compensate expansion and contraction of the covering in the transverse direction on the first pair of opposite edges (2, 3). The panels may be coupled to each other on their first pair of opposite edges (2, 3) by means of a rotating movement (R).

The panels (1) comprise a second pair of opposite edges (94, 95), more specifically a third edge (94) and a fourth edge (95). The panels possess, on their second pair of opposite edges, coupling parts that allow the panels to be coupled, on their third edge, to the fourth edge of another such panel, wherein a locking occurs in the direction in the plane of the thus coupled panels and perpendicular to the thus coupled edges; as well as perpendicular to the plane of the coupled panels. The coupling parts of the second pair of opposite edges (94, 95) may be designed in such a way that the panel can be coupled on its third edge (94) to the fourth edge (95) of another such panel by means of one or more of: a rotating movement, pushing the panel parallel to the plane of the panel with a snap effect, or movement of the third edge of the panel perpendicular to the plane of the panel.

Figure 3:
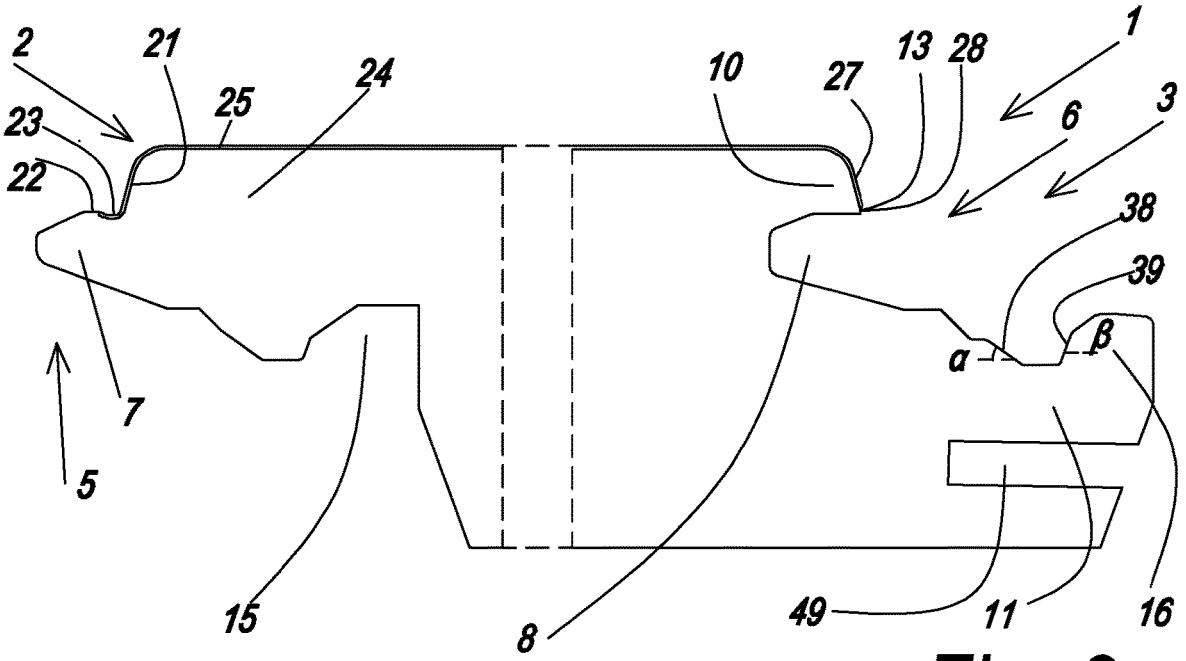
FIG. 3 shows a cross-section through III-III of the panel in FIG. 2.

FIG. 3 shows a cross-section through III-III of the panel (1) according to the invention from FIG. 2.

Figure 5:
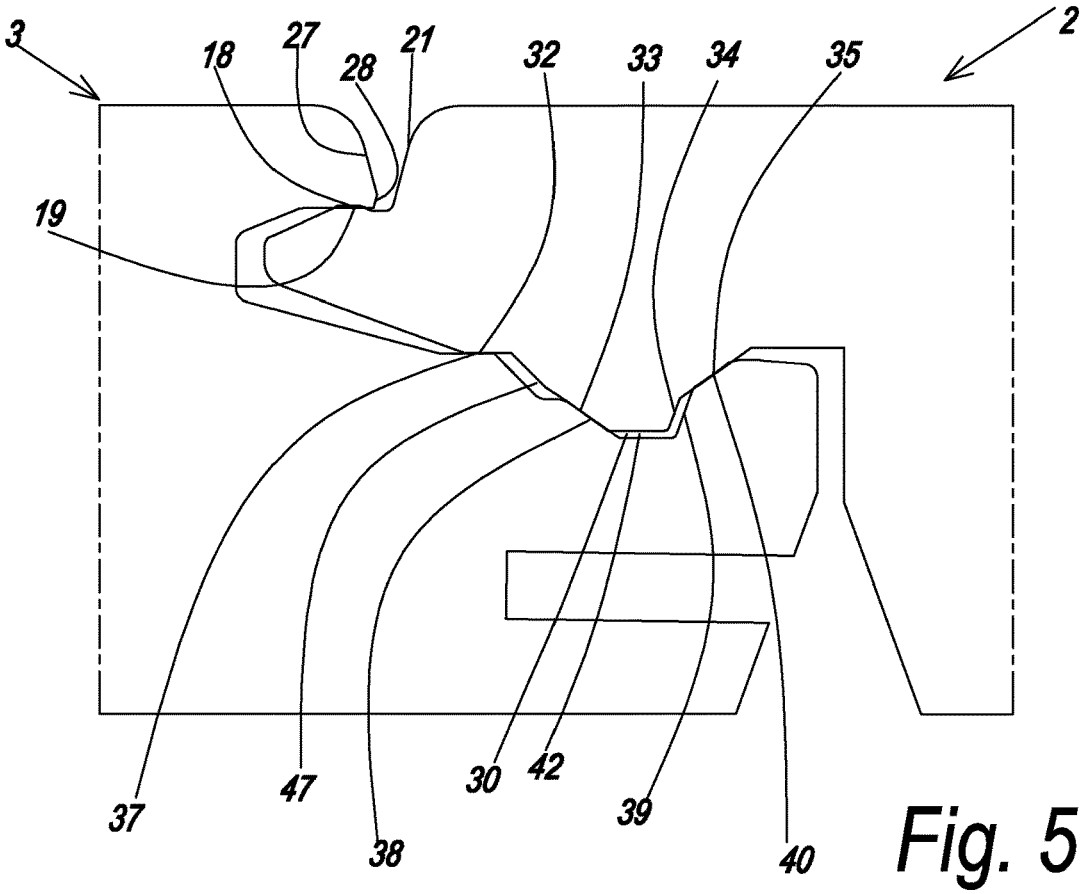
FIG. 5 shows panels according to the invention coupled on their first pair of opposite edges, in the situation just after coupling and moreover at average relative humidity.

FIG. 5 shows the panels according to the invention from FIGS. 2 and 3 coupled on their first pair of opposite edges (2, 3), in the situation just after coupling and moreover at average relative humidity in the floor covering.

Figure 6:
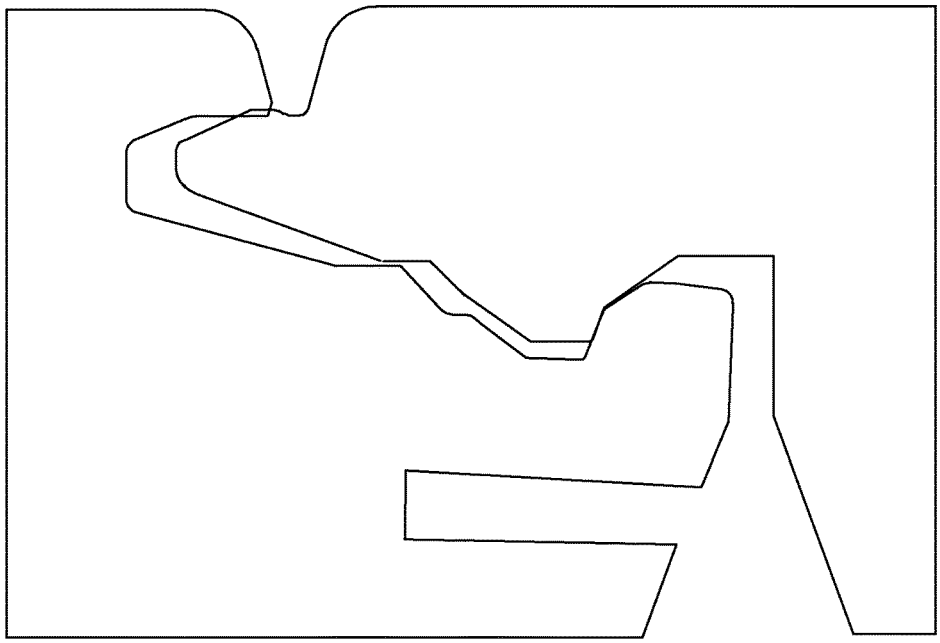
FIG. 6 shows the coupled panels from FIG. 5 in a state at low relative humidity in the room where they are installed.

FIG. 6 shows the coupled panels from FIG. 5 in a state at very low relative humidity in the room where they are installed. This signifies that the panels have shrunk to a considerable extent.

Figure 7:
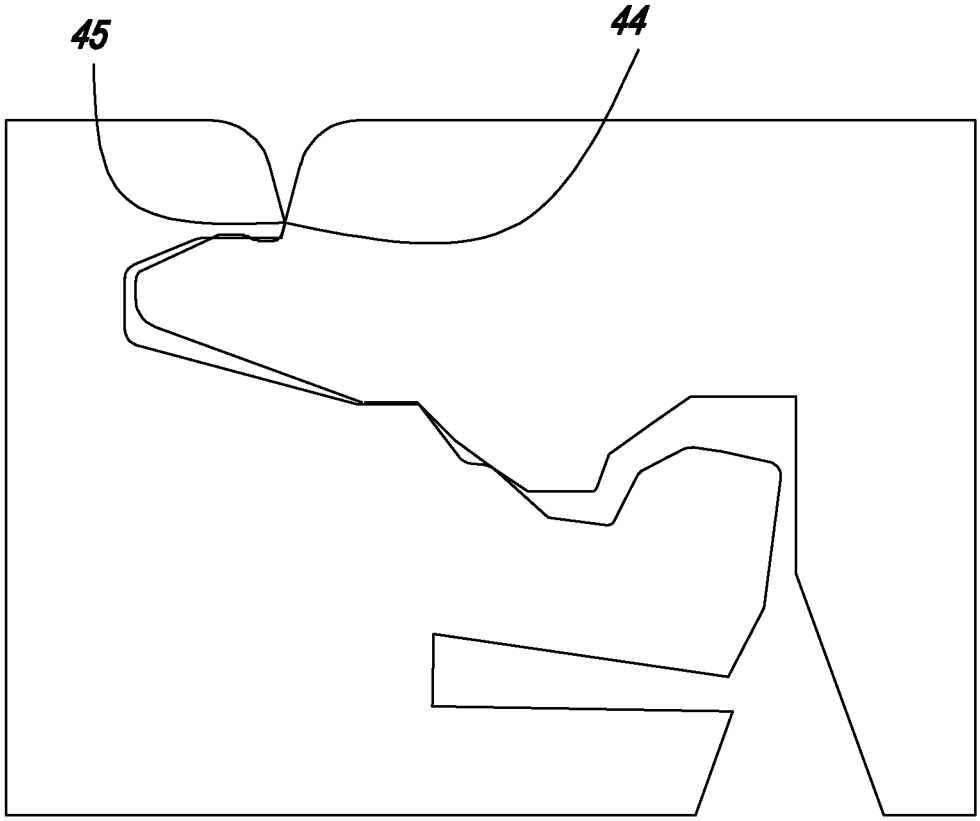
FIG. 7 shows the coupled panels from FIG. 5 in a state at very high relative humidity in the room where they are installed.

FIG. 7 shows the coupled panels from FIG. 5 in a state at very high relative humidity in the room where they are installed. This signifies that the panels have expanded to a considerable extent.

The panel (1) illustrated in FIGS. 1-3 and 5-7 comprises a first pair of opposite edges (2, 3), namely a first edge (2) and a second edge (3). The first edge (2) comprises a male coupling part (5). The second edge (3) comprises a female coupling part (6). The male coupling part (5) and the female coupling part (6) are configured in such a way that two such panels (1) can, by means of their male and female coupling parts (5, 6), be coupled to each other in one plane and a coupled state can thus be realized between the panels (1). The male coupling part (5) comprises a tongue (7). The female coupling part (6) comprises a groove (8), wherein the groove (8) is delimited by an upper lip (10) and a lower lip (11). The lower lip (11) extends in the distal direction beyond the open or free end (13) of the upper lip (10). The tongue (7) and the groove (8) form, in the coupled state, a tongue-and-groove joint, which produces a mechanical locking between the panels (1) in the direction perpendicular to the plane of the panels (1). The male coupling part (5) and the female coupling part (6) each comprise a locking element (15, 16). These locking elements (15, 16) produce, in the coupled state, a mechanical locking between the panels (1) in the direction in the plane of the panels (1) and perpendicular to the first pair of opposite edges (2, 3).

The locking element (15) of the male coupling part (5) is provided on the underside of the tongue (7). The locking element (16) of the female coupling part (6) is provided on the upper side of the lower lip (11).

The tongue (7) and the upper lip (10) are configured with overlapping contours (18, 19), so that in the coupled state of two such panels, on their first pair of opposite edges (2, 3) a pretension is formed between the tongue (7) of the panel and the upper lip (10) of said coupled panel. FIGS. 5, 6 and 7 show these overlapping contours, admittedly not in the state such as occurs in the coupled state. In the coupled state, the surfaces of the overlapping contours in fact come into contact with each other so that a bending occurs in the panel. In the panels according to this example, the lower lip (11) is bent downwards by the aforementioned pretension at any degree of humidity in the room where the coupled panels are located. In panels according to this example, the tongue (7) bends owing to the aforementioned pretension; and not the upper lip (10).

The overlap of the overlapping contours (18, 19) in the direction perpendicular relative to the surface of the panel may be at least 0.03 millimetre; and preferably at least 0.05 millimetre.

The panel (1) comprises, on the top of its first edge (2), a bevel (21). The top edge of the tongue comprises a contact surface (22)—in this example parallel to the upper side of the panel—for coming into contact with the bottom edge of the upper lip (10) of another such panel to which the panel is coupled on its first edge. The tongue (7) comprises a slot (27) that is located between the bevel (21) on the first edge (2) and the contact surface (22) on the top of the tongue. The slot preferably has a depth relative to the uppermost point of the tongue of at least 0.05 millimetre, more preferably of at least 0.1 millimetre, even more preferably of at least 0.15 millimetre.

The width of the slot (23) is greater than its depth, wherein the depth is measured relative to the uppermost point of the tongue.

In the coupled state, just after coupling the panel on its first edge to the second edge of a second such panel, at least one part of the slot is visible from above; this is shown in FIG. 5. The state as shown in FIG. 5 is also the state of the coupled panels on their first pair of opposite edges (2, 3) in non-extreme situations of relative humidity in the room where these coupled panels are located.

The panel comprises a substrate (24) and a decorative design (25). The substrate may be or may comprise an MDF (Medium Density Fibreboard) or an HDF (High Density Fibreboard) substrate. The decorative design runs continuously through from the upper surface over the bevel (21) on the first edge (2) of the panel up to at least a part of the slot (23); and in the example over the entire slot (23). For this purpose the decorative design comprises a decorative layer, which comprises a decorative print. The decorative layer of the example panel comprises a layer of paper, which is printed and is melaminized. The panel of the example is formed as a DPL (Direct Pressure Laminate).

The decorative design (25) on the first edge (2), in the example panel, does not run through onto the contact surface (22) on the top edge of the tongue (7). In order to achieve this, in this example the contact surface (22) on the top edge of the tongue is a milled contact surface. Therefore the contact surface (22) on the top edge of the tongue is formed by substrate (24).

In the example panel, the decorative design (25) on the first edge (2) runs through up to, but not onto the contact surface (22) on the top edge of the tongue (7).

The panel comprises a bevel (27) on the top of its second edge (3). The contact surface (22) of the top of the first edge (2) is located, in the coupled state of the panel on its first edge (2) to the second edge (3) of another such, completely under the bevel (27) on the top of the second edge (3) of the other such panel.

The decorative design (25) runs continuously through from the upper surface up to the bevel (27) on the second edge of the panel. The second edge (3) comprises a second bevel (28), situated under the bevel (27) on the second edge. The second bevel (28), viewed from top to bottom, is directed inwards. The decorative design (25) does not run through up to the second bevel (28). In the example, this second bevel (28) has a height measured perpendicular to the plane of the panel of 0.25 millimetre. The second bevel (28) may be formed by a milling operation.

In the cross-section perpendicular to the first pair of opposite edges (2, 3), the second bevel (28) is flat over at least one part thereof. In this flat part, the second bevel (28) has a tangent, which makes an angle of 75° relative to the upper surface of the panel.

In the coupled state of the panel with its first edge (2) on the second edge (3) of another such panel, in the direction perpendicular to the plane of the panel, the upper lip (10) of the other such panel, lies partly above a decorative design (25) comprising a portion of the tongue (7) of the panel.

As illustrated in FIG. 5, which shows two panels according to the invention immediately after coupling, in the coupled state directly after the coupling of the panel on its first edge (2) to the second edge (3) of a second such panel, a part of the tongue (7) is visible from above. There is a space (30) between the lowest point of the tongue of the panel and the lower lip (11) of the second such panel.

Underneath the tongue (7) there is a first contact surface (32), a first inclined abutting surface (33) and a second inclined abutting surface (34). In the distal direction of the panel, the first contact surface (32) lies farther than the first inclined abutting surface (33), and the first inclined abutting surface (33) lies farther than the second inclined abutting surface (34). On top of the lower lip (11) there is a first counter-contact surface (37), a first inclined counter-abutting surface (38), and a second inclined counter-abutting surface (39). In the distal direction of the panel, the second inclined counter-abutting surface (39) lies farther than the first inclined counter-abutting surface (38), and the first inclined counter-abutting surface (38) lies farther than the first counter-contact surface (37).

The first contact surface (32) is located, relative to the first inclined abutting surface (33) as well as relative to the second inclined abutting surface (34) in the direction perpendicular to the surface of the panel, closer to the upper surface of the panel.

In the coupled state of the panel with another such panel, the first contact surface (32) comes into contact with the first counter-contact surface (37). On expansion or contraction of these coupled panels, the first contact surface (32) of the panel and the first counter-contact surface (37) of the other such panel can move over one another. Depending on the extent of expansion or contraction of the panel and the other such panel to which the panel is coupled on its first edge (2) to the second edge (3) of the other such panel, there can be contact between the first inclined abutting surface (33) of the panel with the first inclined counter-abutting surface (38) of the other such panel (see FIGS. 5 and 7, with non-extreme humidity and with very high relative humidity, respectively), or of the second inclined abutting surface (34) of the panel with the second inclined counter-abutting surface (39) of the other such panel (see FIG. 6, which shows the state at very low relative humidity). There is not, in any situation of temperature or humidity at all, contact both between the first inclined abutting surface (33) of the panel with the first inclined counter-abutting surface (38) of the other such panel and between the second inclined abutting surface (34) of the panel with the second inclined counter-abutting surface (39) of the other such panel.

The first edge (2) and the second edge (3) are configured so that on contact between the first inclined abutting surface (33) of the panel with the first inclined counter-abutting surface (38) of another such panel to which the panel is coupled, in the direction perpendicular to the first pair of opposite edges (2, 3) there is a distance of more than 0.3 mm between the second inclined abutting surface (34) of the panel and the second inclined counter-abutting surface (39) of the other such panel.

The first edge (2) and the second edge (3) are configured so that on contact between the second inclined abutting surface (34) of the panel with the second inclined counter-abutting surface (39) of another such panel to which the panel is coupled, in the direction perpendicular to the first pair of opposite edges, there is a distance of more than 0.3 mm between the first inclined abutting surface (33) of the panel and the first inclined counter-abutting surface (38) of the other such panel.

In the panels in the example, the contact in the coupled state between the first contact surface (32) of the panel and the first counter-contact surface (37) of the other such panel is parallel to the upper surface of the panel.

Underneath the tongue (7) there is an inclined sliding surface (35). In the distal direction of the panel, the second inclined abutting surface (34) lies farther than the inclined sliding surface (35).

The slope of the inclined sliding surface (35) is smaller than the slope of the second inclined abutting surface (34) and smaller than the slope of the first inclined abutting surface (33).

On top of the lower lip (11) there is an inclined counter-sliding surface (40). In the distal direction of the panel, the inclined counter-sliding surface (40) lies farther than the second inclined counter-abutting surface (39). The slope of the inclined counter-sliding surface (40) is smaller than the slope of the second inclined counter-abutting surface (39) and smaller than the slope of the first inclined counter-abutting surface (38). The inclined sliding surface (35) is located, relative to the first inclined abutting surface (33) and relative to the second inclined abutting surface (34) in the direction perpendicular to the surface of the panel, closer to the upper surface of the panel.

As illustrated in FIG. 5, the inclined sliding surface (35) of the panel is provided for coming into contact with the inclined counter-sliding surface (40) of the other such panel in the coupled state just after coupling the panel to the other such panel, so that a locking of these coupled panels is obtained in the plane of the coupled panels and perpendicular to their first pair of opposite edges.

The first pair of opposite edges (2, 3) is designed so that just after coupling there is an overlap between the inclined sliding surface (35) of the panel and the inclined counter-sliding surface (40) of another such panel with which the panel is coupled on its first edge (2) (this state is shown in FIG. 5); so that in this coupled state, the inclined sliding surface (35) of the panel with pretension comes into contact with the inclined counter-sliding surface (40) of the other such panel.

In the coupled state of the panel on its first edge (2) with the second edge (3) of another such panel, there is a space (42) under the tongue (7) and between the first inclined abutting surface (33) and the second inclined abutting surface (34) and above the lower lip (11).

The slopes of the first inclined abutting surface (33) and of the second inclined abutting surface (34) run in opposite directions.

The first edge (2) and the second edge (3) are configured so that on contact between the first inclined abutting surface (33) of the panel with the first inclined counter-abutting surface (38) of another such panel to which the panel is coupled, on further expansion of the panels a stress develops between this first inclined abutting surface (33) and the first inclined counter-abutting surface (38) with which the first inclined abutting surface (33) comes into contact, which causes a bending of the lower lip (11) of the other such panel. This is illustrated in FIG. 7, which shows the state of the coupled panels in a room that has reached a very high relative humidity, so that the coupled panels have expanded considerably.

The first edge (2) and the second edge (3) are configured so that on contact between the second inclined abutting surface (34) of the panel with the second inclined counter-abutting surface (39) of another such panel to which the panel is coupled, on further contraction of the panels a stress develops between this second inclined abutting surface (34) and the second inclined counter-abutting surface (39) with which the second inclined abutting surface (34) comes into contact, which causes a bending of the lower lip (11) of the other such panel. This is illustrated in FIG. 6, which shows the state of coupled panels in a room that has reached a very low relative humidity, so that the coupled panels have shrunk considerably.

The panel (1) in the example has, on the first edge (2) above the tongue (7), a first closing face (44). The second edge (3) has a second closing face (45). Directly after coupling of the panel on its first edge (2) to the second edge (3) of the other such panel, between the first closing face (44) of the panel and the second closing face (45) of the other such panel in the direction perpendicular to the first pair of opposite edges (2, 3) of the thus coupled panels, there is at least a distance of 0.35 millimetre. FIG. 5 shows the state after coupling of two panels on their first pair of opposite edges (2, 3). At a certain expansion of the panel and of the other such panel with which the panel is coupled on its first edge (2) to the second edge (3) of the other such panel, there is contact between the first closing face (44) of the panel and the second closing face (45) of the other such panel. This is illustrated in FIG. 7, which shows the coupled panels when the relative humidity is very high in the room where the panels are installed, and thus considerable expansion of the panels occurs.

The first edge (2) and the second edge (3) are configured so that on contact between the first inclined abutting surface (33) of the panel with the first inclined counter-abutting surface (34) of another such panel to which the panel is coupled, in the direction perpendicular to the first pair of opposite edges, there is a distance of more than 0.3 mm; and preferably more than 0.35 mm between the second inclined abutting surface (34) of the panel and the second inclined counter-abutting surface (39) of the other such panel.

The first edge (2) and the second edge (3) are configured so that on contact between the second inclined abutting surface (34) of the panel with the second inclined counter-abutting surface (39) of another such panel to which the panel is coupled, in the direction perpendicular to the first pair of opposite edges, there is a distance of more than 0.3 mm; and preferably more than 0.35 mm between the first inclined abutting surface (33) of the panel and the first inclined counter-abutting surface (38) of the other such panel.

The included angle of inclination (B) of the second inclined counter-abutting surface (39) to the plane of the panel is greater than the included angle of inclination (a) of the first inclined counter-abutting surface (38) to the plane of the panel; in the example this difference is 35°.

Underneath the tongue (7), there is a zone between the first contact surface (32) and the first inclined abutting surface (33). In all conditions of humidity and temperature, in the coupled state on the first edge (2) of the panel to the second edge (3) of another such panel in the direction parallel to the surface of these coupled panels, there is a space (47) between this zone and the lower lip (11) of the other such panel to which the panel is coupled on its first edge.

In the case of the panel in the example shown in FIGS. 1-3 and 5-7, the second edge (3) comprises a notch (49) under the lower lip (11). The length of the notch (49), measured in the plane parallel to the surface of the panel and perpendicular to the second edge, is smaller than the distance between the most distal point of the upper lip (10) and the most distal point of the lower lip (11).

The lower lip (11) possesses a most proximal contact surface at the top. This most proximal contact surface comes into contact, in the coupled state, with the underside of the tongue of a coupled panel, wherein, in the coupled state of the panel, on its second edge there is no contact surface at the top of the lower lip more proximal than the most proximal contact surface. The notch (49) does not extend from the distal end of the second edge (3) beyond the most proximal contact surface.

The panel in the example that comprises an MDF or an HDF substrate, under the influence of temperature changes and/or changes in air humidity, in relative terms, changes less in dimension in the direction parallel to the first pair of opposite edges (2, 3) than in the direction perpendicular to the first pair of opposite edges (2, 3).

Figure 4:
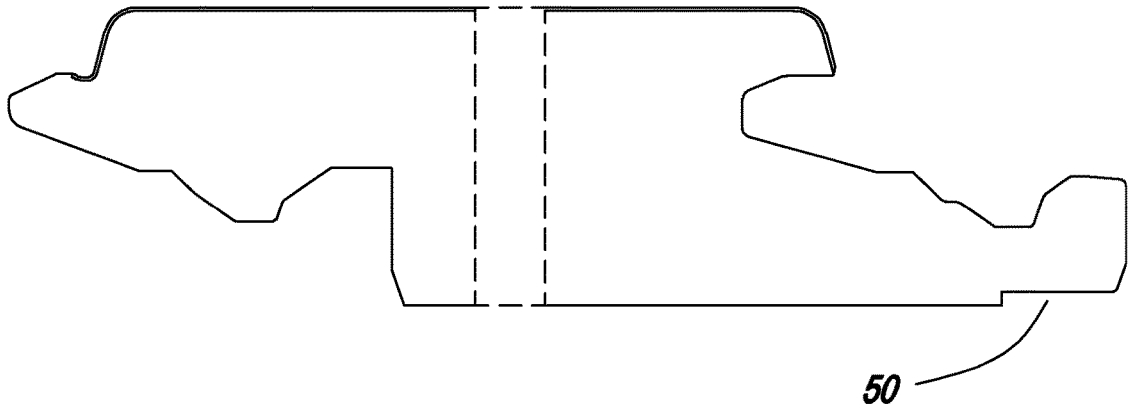
FIG. 4 shows a cross-section of an alternative panel according to the invention.

FIG. 4 shows a cross-section of an alternative panel according to the invention. The panel in FIG. 4 is thinner than the panel illustrated in FIGS. 3 and 5-7. Instead of a notch, the second edge comprises an undercut (50) under the lower lip of the panel in FIG. 4. This undercut (50) has the same function as the notch of the panel in FIG. 3. The length of the undercut (50), measured in the plane parallel to the surface of the panel and perpendicular to the second edge, is smaller than the distance between the most distal point of the upper lip (10) and the most distal point of the lower lip (11). Moreover, the panel in FIG. 4 is configured like the panel in FIG. 3. However, variations might well occur in the configuration of the panel according to the various aspects and embodiments of the invention described.

Figure 8:
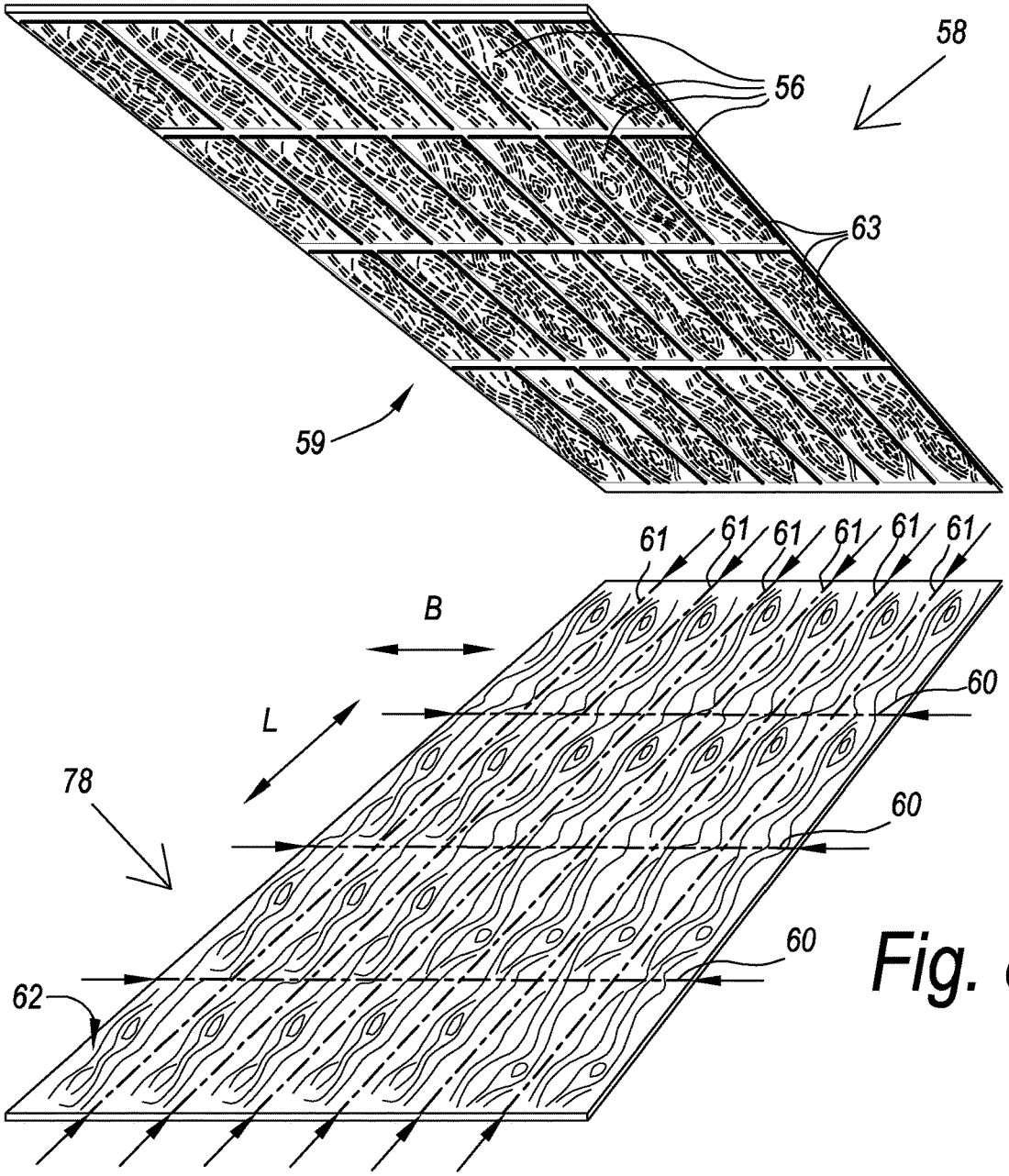
FIG. 8 illustrates steps of a production process that can be used for producing examples of panels according to the invention.
Figure 9:
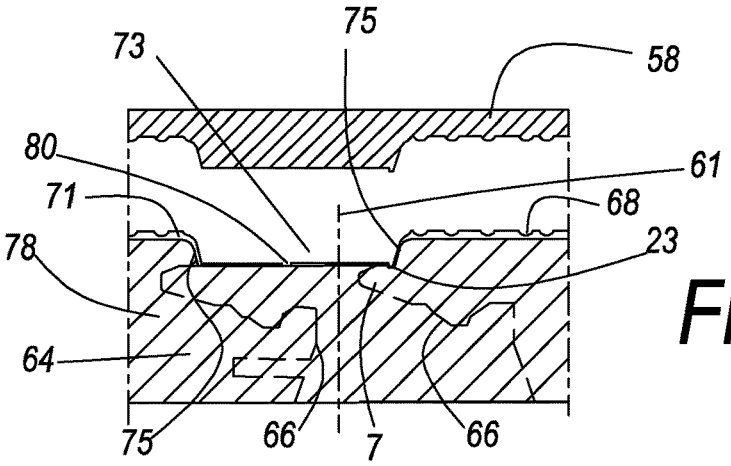
FIG. 9 shows a detail from FIG. 8.

FIG. 8 illustrates steps of a production process that can be used for producing examples of panels according to the invention. FIG. 9 shows a detail from FIG. 8. FIGS. 8 and 9 show an already pressed board (78)—with its decorative side (62)—from which panels according to the invention can be produced. The pressed board (78) consists of a substrate (64), preferably an HDF (High Density Fibreboard) substrate, on which a melaminized printed paper sheet (71) and optionally overlays (e.g. melaminized paper sheets that contain particles in order to increase the wear resistance of the panel) have been placed. Grooves (73), for applying the melaminized printed paper sheet and the optional overlays, have already been milled in the substrate. By means of a pressing element (58), the layers that are then applied (melaminized printed paper sheet and the optional overlays) are pressed onto the substrate. This takes place by means of the so-called DPL (Direct Pressure Laminate) process. FIGS. 7 and 8 show the board (78) after pressing by means of the pressing element (58). The pressing element (58) has a pressing side (59), which will form the sections (56), which will then form the surface of the panels.

During the pressing operation, the applied layers (melaminized printed paper sheet and the optional overlays) will display a split (80) in the zones where the grooves (73) were milled beforehand. As will be seen later, this split is located in zones of the board that will be removed, and thus will not form part of the panels.

The pressing side (59) of the pressing element (58) may comprise irregularities or projections (63), which by means of indentations (68) will form a relief on the surface of the pressed board (78), and thus on the panels. During this pressing, the slot (23) and the bevels (75) are also formed; these are covered with the melaminized printed paper sheet. In this process, the bevels are partially pressed into the substrate, and a so-called "pressed bevel" can thus be formed. The slot (23) is a component of the tongue (7), which can be provided over an extensive upper surface with melaminized printed paper.

The pressed board (78) is then sawn along sawing lines (60, 61), after which the coupling parts (66) can be formed on the edges of the panels, preferably by means of milling operations. It is also possible to mill a contact surface on the top edge of the tongue; narrow tolerances for this contact surface can be achieved in this way. If this contact surface is milled on the top edge of the tongue, then during milling, the melaminized printed paper at this position is milled away.

The invention claimed is:

1. A panel, wherein the panel comprises a first pair of opposite edges, including a first edge and a second edge;

wherein the first edge comprises a male coupling part, wherein the second edge comprises a female coupling part, wherein the male coupling part and the female coupling part are configured in such a way that first and second panels formed according to said panel, can, by the male and female coupling parts of the first and second panels, be coupled to each other in a plane and a coupled state can be realized between the first and second panels, said coupled state being defined as a condition at a completion of an installation of the first and second panels in both horizontal and vertical directions;

wherein the male coupling part comprises a tongue;

wherein the female coupling part comprises a groove, wherein the groove is delimited by an upper lip and a lower lip;

wherein the lower lip extends in a distal direction beyond an open or free end of the upper lip;

wherein the tongue and the groove, in the coupled state, form a tongue-and-groove joint, which produces a mechanical locking between the first and second panels in a direction perpendicular to the plane of the first and second panels;

wherein the male coupling part and the female coupling part each comprise a locking element, said locking elements, in the coupled state, produce a mechanical locking between the first and second panels in the direction in the plane of the first and second panels and perpendicular to the first pair of opposite edges;

wherein the tongue and the upper lip are configured with overlapping contours, so that in the coupled state of the first and second panels, on the first pair of opposite edges of the first and second panels a pretension is formed between the tongue of the first panel and the upper lip of the second panel;

wherein, on account of the pretension, the lower lip in the coupled state is bent downwards at any degree of humidity;

wherein due to the pretension, the tongue is arranged to bend, and the upper lip is arranged not to bend.

2. The panel as in claim 1, wherein an overlap of the overlapping contours in the direction perpendicular relative to a surface of the panel is at least 0.03 millimetre.

3. A panel, wherein the panel comprises a first pair of opposite edges, including a first edge and a second edge;

wherein the first edge comprises a male coupling part, wherein the second edge comprises a female coupling part, wherein the male coupling part and the female coupling part are configured in such a way that first and second panels formed according to said panel can be coupled to each other in a plane by the male and female coupling parts, and a coupled state can be realized between the first and second panels, said coupled state being defined as a condition at a completion of an installation of the first and second panels in both horizontal and vertical directions;

wherein the male coupling part comprises a tongue;

wherein the female coupling part comprises a groove, wherein the groove is delimited by an upper lip and a lower lip;

wherein the lower lip extends in a distal direction beyond an open or free end of the upper lip;

wherein the tongue and the groove, in the coupled state, form a tongue-and-groove joint, which produces a mechanical locking between the first and second panels in a direction perpendicular to the plane of the first and second panels;

wherein the male coupling part and the female coupling part each comprise a locking element, said locking elements, in the coupled state, produce a mechanical locking between the first and second panels in the direction in the plane of the first and second panels and perpendicular to the first pair of opposite edges;

wherein the panel comprises a first bevel arranged as straight or curved on a top of the first edge;

wherein a top edge of the tongue comprises a contact surface being parallel to an upper side of the first panel for coming into contact with a bottom edge of the upper lip of the second panel to which the first panel is coupled on the first edge;

wherein the tongue comprises a slot, wherein the slot is located between the first bevel on the first edge and the contact surface on the top edge of the tongue, wherein the slot has a depth relative to the uppermost point of the tongue of at least 0.05 millimetre;

wherein, in the coupled state just after coupling the first panel on the first edge thereof to the second edge of the second panel, at least one part of the slot is visible from above.

4. The panel as in claim 3, wherein a width of the slot is greater than a depth thereof, wherein the depth is measured relative to an uppermost point of the tongue.

5. The panel as in any claim 3, wherein the panel comprises a substrate and a decorative design;

wherein the decorative design runs continuously from an upper surface over the first bevel on the first edge of the panel up to at least a part of the slot; and over an entirety of the slot.

6. The panel as in claim 5, wherein the decorative design on the tongue does not run beyond the slot.

7. The panel as in claim 5, wherein the decorative design on the first edge does not run onto the contact surface on the top edge of the tongue.

8. The panel as in claim 7, wherein the contact surface on the top edge of the tongue is a milled contact surface.

9. The panel as in claim 5, wherein the panel comprises a substrate and a decorative design, wherein the contact surface on the top edge of the tongue is formed from substrate.

10. The panel as in claim 5, wherein the decorative design on the first edge runs up to, but not onto the contact surface on the top edge of the tongue.

11. The panel such in claim 5, wherein the decorative design on the tongue runs continuously to beyond the slot.

12. The panel as in claim 3, wherein the panel comprises a second bevel arranged as straight or curved on a top of the second edge;

wherein the contact surface of the top of the first edge, in the coupled state of the first panel on the first edge to the second edge of the second panel, is located completely under the second bevel on the top of the second edge of the second panel.

13. A panel, wherein the panel comprises a first pair of opposite edges, including a first edge and a second edge;

wherein the first edge comprises a male coupling part, wherein the second edge comprises a female coupling part, wherein the male coupling part and the female coupling part are configured in such a way that first and second panels formed according to said panel can, by the male and female coupling parts, be coupled to each other in a plane and a coupled state can be realized between the first and second panels, said coupled state being defined as a condition at a completion of an installation of the first and second panels in both horizontal and vertical directions;

wherein the male coupling part comprises a tongue;

wherein the female coupling part comprises a groove, wherein the groove is delimited by an upper lip and a lower lip;

wherein the lower lip extends in a distal direction beyond an open or free end of the upper lip;

wherein the tongue and the groove, in the coupled state, form a tongue-and-groove joint, which produces a mechanical locking between the first and second panels in a direction perpendicular to the plane of the first and second panels;

wherein the male coupling part and the female coupling part each comprise a locking element, said locking elements, in the coupled state, produce a mechanical locking between the first and second panels in the direction in the plane of the first and second panels and perpendicular to the first pair of opposite edges;

wherein the panel comprises a substrate and a decorative design;

wherein the panel comprises a first bevel arranged as straight and/or curved on a top of the first edge;

wherein the decorative design runs continuously from an upper surface of the panel over the first bevel to the first edge of the panel up to at least a part of an upper surface of the tongue;

wherein the second edge comprises a second bevel arranged as straight and/or curved under the first bevel on the second edge, wherein the second bevel, viewed from top to bottom, is directed inwards; wherein the decorative design does not run onto the second bevel;

wherein the second bevel has a height, measured perpendicular to the plane of the panel, of at least 0.10 millimetre;

wherein the decorative design comprises a paper impregnated with resin;

wherein the first bevel on the first edge of the panel and the first bevel on the second edge of the panel are covered with paper impregnated with resin;

wherein in the coupled state of the first panel with the first edge on the second edge of the second panel, in a direction perpendicular to the plane of the first panel the upper lip of the second panel lies partly above a portion of the tongue of the panel containing the decorative design.

14. The panel as in claim 13, wherein the decorative design comprises a decorative layer, wherein the decorative layer comprises a decorative print.

15. The panel as in claim 13, wherein, in a cross-section perpendicular to the first pair of opposite edges, the second bevel has, in at least one point thereof, a tangent which, relative to the upper surface of the panel, makes an angle of more than 40°.

16. The panel as in claim 13, wherein in a cross-section perpendicular to the first pair of opposite edges, the second bevel is flat over at least one part thereof.

* * * * *